US007334522B2

(12) United States Patent
Burger et al.

(10) Patent No.: US 7,334,522 B2
(45) Date of Patent: Feb. 26, 2008

(54) APPARATUS AND METHOD FOR REDUCING OSCILLATIONS IN A WEB-FED ROTARY PRESS

(75) Inventors: Rainer Burger, Augsburg (DE); Norbert Dylla, Stadtbergen (DE); Thomas John, Augsburg (DE); Manfred Stegmeir, Augsburg (DE)

(73) Assignee: Man Roland Druckmaschinen AG, Augsburg (DE)

( * ) Notice: Subject to any disclaimer, the term of this patent is extended or adjusted under 35 U.S.C. 154(b) by 0 days.

(21) Appl. No.: 11/180,099

(22) Filed: Jul. 12, 2005

(65) Prior Publication Data

US 2006/0011079 A1 Jan. 19, 2006

(30) Foreign Application Priority Data

Jul. 13, 2004 (DE) ..... 10 2004 034 049

(51) Int. Cl.
*B41F 27/12* (2006.01)

(52) U.S. Cl. ..... 101/415.1; 101/378

(58) Field of Classification Search ..... 101/415.1, 101/378

See application file for complete search history.

(56) References Cited

U.S. PATENT DOCUMENTS

| | | | | |
|---|---|---|---|---|
| 2,209,127 | A * | 7/1940 | Lowe | 101/415.1 |
| 2,764,089 | A * | 9/1956 | Bachman | 101/415.1 |
| 3,191,532 | A * | 6/1965 | Hermach et al. | 101/415.1 |
| 3,626,848 | A * | 12/1971 | Tafel et al. | 101/415.1 |
| 4,421,024 | A * | 12/1983 | Burger et al. | 101/415.1 |
| 5,423,258 | A * | 6/1995 | Weber | 101/415.1 |
| 6,401,617 | B1 * | 6/2002 | Lyndhurst | 101/415.1 |
| 6,578,484 | B2 * | 6/2003 | Fusco | 101/415.1 |
| 6,601,508 | B1 * | 8/2003 | Chagnon | 101/415.1 |
| 2002/0189470 | A1 * | 12/2002 | Holm | 101/375 |
| 2003/0097946 | A1 * | 5/2003 | Kawabata et al. | 101/415.1 |
| 2004/0050276 | A1 * | 3/2004 | Schafer | 101/415.1 |

FOREIGN PATENT DOCUMENTS

| | | |
|---|---|---|
| DE | 31 16 506 | 11/1982 |
| DE | 42 38 343 | 5/1994 |
| DE | 43 19 167 | 12/1994 |
| DE | 196 06 744 | 8/1997 |
| DE | 199 61 574 | 7/2001 |
| DE | 100 60 171 | 5/2002 |
| DE | 102 45 659 | 6/2003 |
| DE | 102 37 205 | 11/2003 |
| DE | 102 28 968 | 1/2004 |
| DE | 102 50 684 | 4/2004 |
| DE | 102 49 947 | 5/2004 |
| EP | 1 371 485 | 12/2003 |

* cited by examiner

*Primary Examiner*—Leslie J Evanisko
(74) *Attorney, Agent, or Firm*—Crowell & Moring LLP

(57) ABSTRACT

An apparatus and method for reducing oscillations in a web-fed rotary press are disclosed. The apparatus includes a form cylinder of a web-fed rotary press, having at least one clamping device for fastening at least one printing plate on the form cylinder. The clamping device has at least one clamping element which is positioned in a clamping channel. As seen in a circumferential direction, the clamping channel of the form cylinder has an effective clamping-channel width of at most 7 mm.

13 Claims, 2 Drawing Sheets

APPARATUS AND METHOD FOR REDUCING OSCILLATIONS IN A WEB-FED ROTARY PRESS

This application claims the priority of German Patent Document No. 10 2004 034 049.8, filed Jul. 13, 2004, the disclosure of which is expressly incorporated by reference herein.

BACKGROUND AND SUMMARY OF THE INVENTION

The invention relates to a form cylinder of a web-fed rotary press.

Web-fed printing presses, in particular newspaper presses, have a plurality of printing units, each printing unit having, inter alia, at least one form cylinder and at least one transfer cylinder. Printing plates are fastened on the form cylinders and rubber blankets are fastened on the transfer cylinders, for which reason the form cylinders are also referred to as printing plate cylinders and the transfer cylinders are also referred to as blanket cylinders. A transfer cylinder interacts with every form cylinder in such a way that, during printing, a form cylinder rolls on the respective transfer cylinder. Accordingly, there is rolling contact during printing between the form cylinders and the transfer cylinders. During printing or while the form cylinders are rolling on the respective transfer cylinders, cylinder oscillations can form which impair the printing quality. Accordingly, cylinder oscillations have to be minimized in order to ensure satisfactory printing quality.

Proceeding from this, the present invention is based on the problem of providing a novel, oscillation-minimizing form cylinder of a web-fed rotary press.

According to the invention, a clamping channel of the form cylinder has an effective clamping-channel width of at most 7 millimeters (mm), as seen in the circumferential direction. Cylinder oscillations which occur during printing can be reduced considerably by adapting the clamping-channel width to less than 7 mm.

As seen in the circumferential direction, the clamping channel of the form cylinder has an effective clamping-channel width of from 3 mm to 7 mm. In the context of the invention, the following ranges are preferred for the effective clamping-channel width between 3 mm and 7 mm: from 3 mm to 6 mm; from 3 mm to 5 mm; from 3 mm to 4 mm; from 4 mm to 7 mm; from 4 mm to 6 mm; from 4 mm to 5 mm; from 5 mm to 7 mm; from 5 mm to 6 mm; and from 6 mm to 7 mm.

BRIEF DESCRIPTION OF THE DRAWINGS

Preferred developments of the invention result from the following description. Without being restricted thereto, exemplary embodiments of the invention will be explained in greater detail using the drawings, in which.

DETAILED DESCRIPTION OF THE DRAWINGS

In the following text, the present invention will be described in greater detail with reference to FIGS. 1 to 4.

Figure 1:
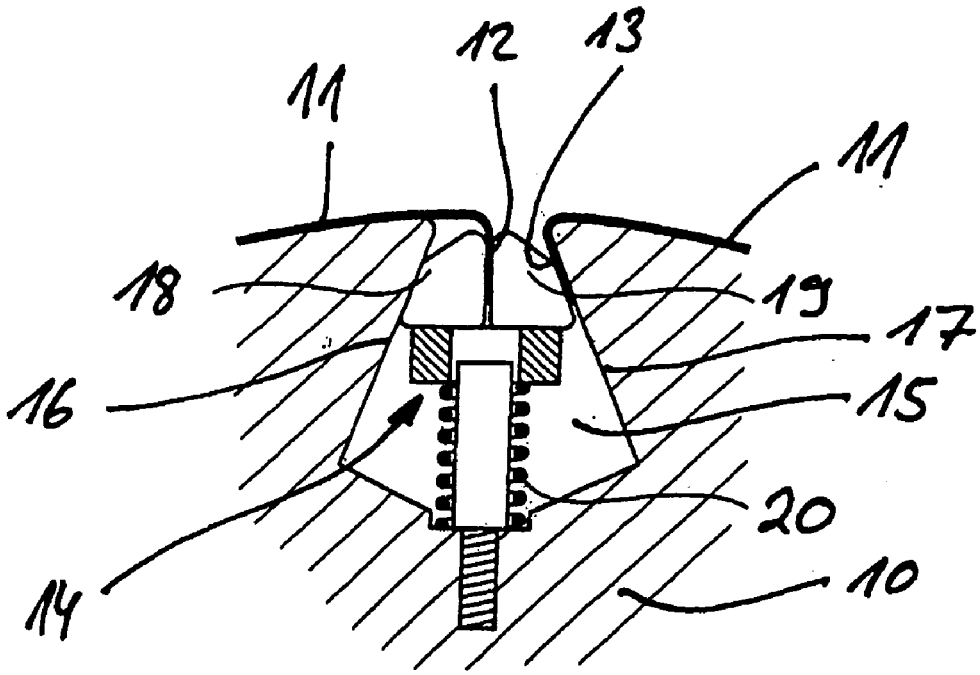
FIG. 1 shows a cross-section through a form cylinder according to the invention of a web-fed rotary press according to a first exemplary embodiment of the invention, together with a printing plate in a first position.
Figure 2:
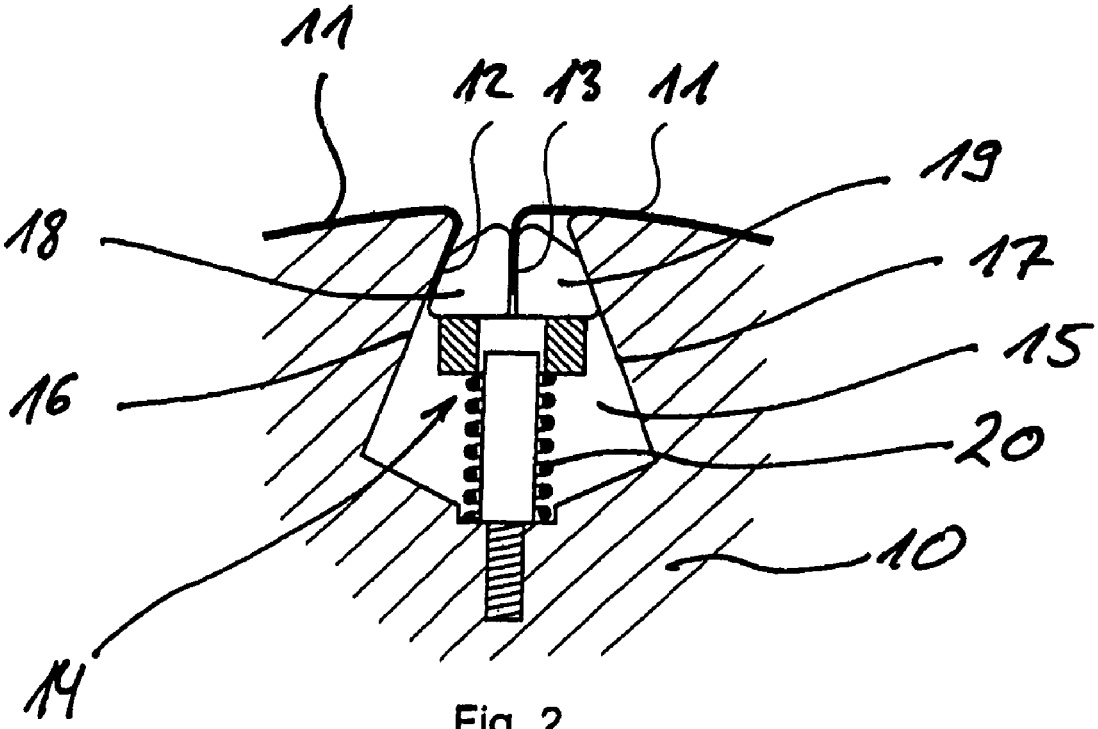
FIG. 2 shows the arrangement from FIG. 1 with a printing plate in a second position.

FIGS. 1 and 2 show a first exemplary embodiment of a form cylinder 10 according to the invention in details of a cross-section, together with a printing plate 11 which is to be clamped on the form cylinder 10. In the exemplary embodiment from FIGS. 1 and 2, it should be assumed in the following text that a printing plate 11 is clamped on the form cylinder 10 at an axial position of the form cylinder 10 in the circumferential direction of the latter, with the result that the ends 12 and 13 which are shown in FIG. 1 are ends of one and the same printing plate 11.

In the exemplary embodiment of FIGS. 1 and 2, the printing plate 11 is clamped with the aid of a clamping device 14, the clamping device 14 being positioned in a clamping channel 15. In the exemplary embodiment of FIGS. 1 and 2, the clamping channel 15 extends over the entire axial length of the form cylinder 10, bounding faces 16 and 17 tapering in the direction of the circumferential surface of the form cylinder 10 in a radially outward manner which starts from the inside.

In the exemplary embodiment from FIGS. 1 and 2, the clamping device 14, which is positioned within the clamping channel 15, has two wedge-shaped clamping elements 18 and 19 which are actuated by a spring element 20 and are pressed via the spring force of the spring element 20 against the bounding faces 16 and 17 of the clamping channel 15. As can be gathered from FIG. 1, the end 12 of the printing plate 11 is clamped between the two clamping elements 18 and 19, whereas the end 13 is fixed between the clamping element 19 and the bounding wall 17 of the clamping channel 15. The refinement of the clamping device 14 with two clamping elements 18 and 19 has the advantage that, in a change to the rotational direction of the form cylinder 10, the clamping direction of the printing plate 11 can be adapted, as can be gathered from a comparison of FIGS. 1 and 2. Thus, in FIG. 2, the end 13 of the printing plate 11 is positioned between the two clamping elements 18 and 19, whereas the end 12 is clamped between the clamping element 18 and the bounding face 16 of the clamping channel 15.

In the context of the present invention, it is proposed that the clamping channel 15 be configured in such a way that, in the circumferential direction of the form cylinder 10, the clamping channel 15 has an effective channel width of at most 7 mm or of less than 7 mm. In the event of effective clamping-channel widths of less than 7 mm, no impermissibly high cylinder oscillations occur any more during printing and therefore during the rolling contact between the form cylinder and a corresponding transfer cylinder or blanket cylinder, as a result of which the printing quality can be improved considerably.

In the context of the present invention, the effective clamping-channel width preferably lies between 3 mm and 7 mm, in particular in the following ranges:

- from 3 mm to 6 mm; or from 3 mm to 5 mm; or from 3 mm to 4 mm; or
- from 4 mm to 7 mm; or from 4 mm to 6 mm; or from 4 mm to 5 mm; or
- from 5 mm to 7 mm; or from 5 mm to 6 mm; or
- from 6 mm to 7 mm.

From the range of from 3 mm to 7 mm, a very wide variety of partial ranges are accordingly conceivable for the effective clamping-channel width.

As has already been mentioned, the form cylinder 10 in the exemplary embodiment from FIGS. 1 and 2 has only one clamping channel 15 which extends over the entire axial length of the form cylinder 10. Here, the form cylinder 10 or the clamping channel 15 has such an axial length that at least two printing plates can be positioned along the axial length of the form cylinder 10 or of the clamping channel 15, next to one another in the axial direction. It is also possible to provide or to clamp only one printing plate on the form cylinder in the axial direction.

According to a first alternative, the form cylinder 10 or the clamping channel 15 has such an axial length that two printing plates can be positioned next to one another in the axial direction. According to a second alternative, the form cylinder 10 or the clamping channel 15 has such an axial length that three printing plates can be positioned next to one another in the axial direction. According to a third alternative, the form cylinder 10 or the clamping channel 15 has such an axial length that four or else six printing plates can be positioned next to one another in the axial direction. Furthermore, it is also conceivable that five or seven or eight printing plates can be positioned on the form cylinder 10 next to one another in the axial direction.

As, in the exemplary embodiment from FIGS. 1 and 2, there is only one clamping channel 15 which extends over the entire axial length of the form cylinder 10, in each case one printing plate can be clamped on the form cylinder 10 in the circumferential direction of the form cylinder 10.

Here, the printing plates can have one or more vertical printing pages in the circumferential direction and/or axial direction and/or one or more horizontal printing pages in the circumferential direction and/or axial direction. A printing plate can have, for example, two vertical printing pages one behind another in the circumferential direction. Furthermore, a printing plate can also have, for example, four horizontal printing pages next to one another in the axial direction. It is also possible that a printing plate has a combination of vertical and horizontal pages which are positioned both next to one another in the axial direction and behind one another in the circumferential direction.

In contrast to the exemplary embodiment from FIGS. 1 and 2, it is also conceivable that the form cylinder has two clamping channels which extend over the entire axial length of the former and are offset with respect to one another in the circumferential direction by approximately 180°, it then being possible for in each case two printing plates to be clamped in the corresponding clamping channels one behind another in the circumferential direction. Here, each of these printing plates can once again correspond to one vertical printing page or two horizontal printing pages. If in each case four printing plates are to be positioned on the form cylinder behind one another in the circumferential direction, the form cylinder has four clamping channels which extend over the entire axial length of the former and are preferably offset with respect to one another in the circumferential direction by approximately 90°.

Furthermore, it is conceivable that the form cylinder has a plurality of clamping channels which extend along the form cylinder in the axial direction only in sections. In this case, according to a first alternative, there can be in each case only one clamping channel at every axial position of the form cylinder as seen in the circumferential direction, at least one clamping channel then being offset in the circumferential direction compared with the other clamping channels. According to a second alternative, there can be two clamping channels at each axial position of the form cylinder as seen in the circumferential direction, at least two clamping channels of the form cylinder which extend at the same axial position then being offset in the circumferential direction compared with the other clamping channels of the form cylinder. According to a further alternative, there can be a group of at least two, preferably two or four, clamping channels at each axial position of the form cylinder as seen in the circumferential direction, at least one group of clamping channels which extend at the same axial position being offset in the circumferential direction compared with the other clamping channels of the other groups. Cylinder oscillations can be minimized once again by the configuration of the clamping channels on the form cylinders which are offset in the circumferential direction. In every case, however, the effective clamping-channel width of all the clamping channels is at most 7 mm, the effective clamping-channel width lying between 3 mm and 7 mm, preferably between 4 mm and 5 mm, or alternatively between 6 mm and 7 mm.

Figure 3:
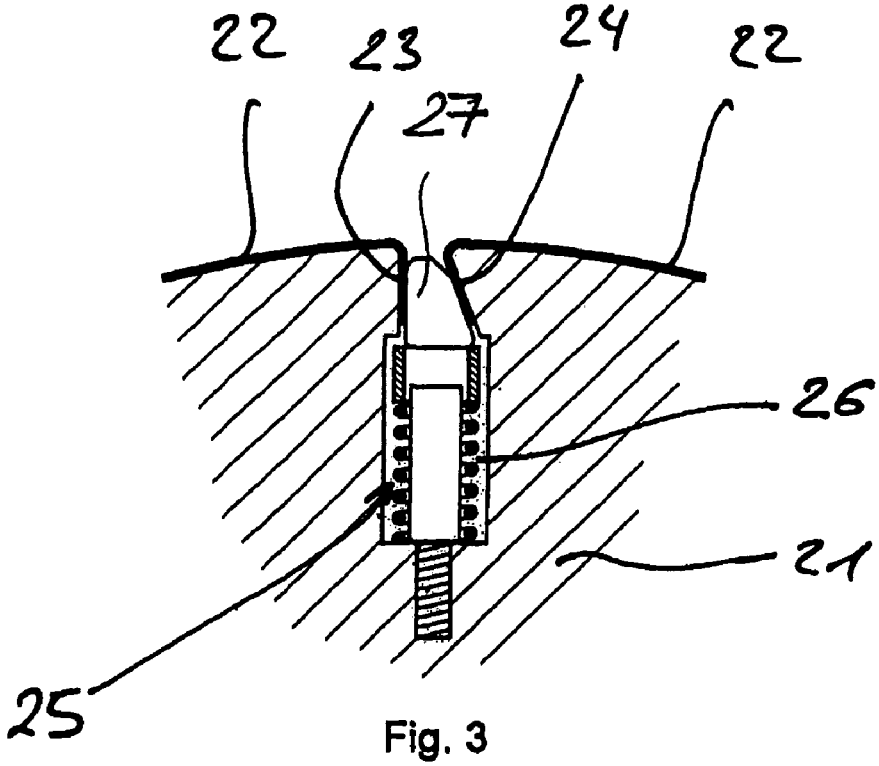
FIG. 3 shows a cross-section through a form cylinder according to the invention of a web-fed rotary press according to a second exemplary embodiment of the invention.

FIG. 3 shows a further exemplary embodiment of a form cylinder 21 according to the invention together with a printing plate 22, it being possible to clamp ends 23 and 24 of the printing plate 22 on the form cylinder 21 with the aid of a clamping device 25. The clamping device 25 is once again positioned in a clamping channel 26. The exemplary embodiment from FIG. 3 differs from the exemplary embodiment from FIGS. 1 and 2 only by virtue of the fact that, in the exemplary embodiment from FIG. 3, the clamping device 25 has only one clamping element 27. A clamping device 25 having one clamping element 27 is then sufficient if the functionality of a rotational-direction change is not required on the form cylinder. With regard to the remaining details, however, the exemplary embodiment from FIG. 3 coincides with the exemplary embodiment from FIGS. 1 and 2, with the result that reference can be made to the above explanations in order to avoid unnecessary repetition.

Figure 4:
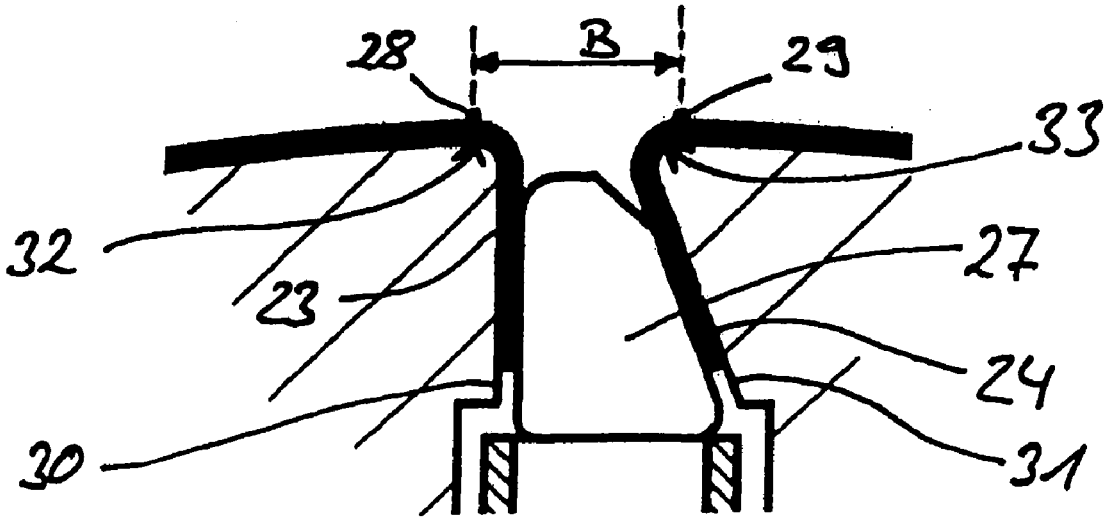
FIG. 4 shows an enlarged detail of the arrangement from FIG. 3, in order to clarify the term "effective clamping-channel width".

With reference to FIGS. 1 to 3, the term "effective clamping-channel width" has been used multiple times, which term is to be defined in the following text with reference to FIG. 4. The form cylinder has a circumferential surface of circular cross-section which is interrupted by one or more clamping channels. The "effective clamping-channel width" is to be understood as the spacing B (see FIG. 4) between the points 28 and 29, at which points the clamping-channel contour of a clamping channel begins to deviate from the circular circumferential surface of the form cylinder. In the example from FIG. 4, in each case a rounded transition region 32 and 33 is formed between the circular circumferential surface of the form cylinder and the actual clamping-channel contour from bounding faces 30, 31 which taper outwardly in the radial direction. At the points 28 and 29, accordingly, the transition regions 32 and 33 begin to deviate from the circular circumferential surface of the form cylinder and to merge into the clamping-channel contour. The transition regions between the circular circumferential surface of the form cylinder and the actual clamping-channel contour from the bounding faces which taper outwardly in the radial direction do not need to be of rounded configuration, but can rather be of any desired configuration, for example with a chamfer or bevel.

According to the basic idea of the present invention, the clamping-channel width on form cylinders is limited to an effective clamping-channel width of at most 7 mm, in order to minimize cylinder oscillations which impair the printing quality. This is true both when the form cylinder has only one clamping channel or also has a plurality of clamping channels. If the form cylinder has a plurality of clamping channels which do not extend over the whole axial length of the form cylinder but rather extend along the form cylinder only in sections, the clamping channels can be additionally offset with respect to one another in the circumferential direction, as a result of which cylinder oscillations during printing can be minimized further.

LIST OF REFERENCE NUMERALS

10 Form cylinder
11 Printing plate
12 End
13 End
14 Clamping device
15 Clamping channel
16 Bounding face
17 Bounding face
18 Clamping element
19 Clamping element
20 Spring element
21 Form cylinder
22 Printing plate
23 End
24 End
25 Clamping device
26 Clamping channel
27 Clamping element
28 Point
29 Point
30 Bounding face
31 Bounding face
32 Transition region
33 Transition region The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus in a web-fed rotary press, comprising:

a form cylinder; and a clamping device for fastening at least one printing plate on the form cylinder, wherein the clamping device is threadedly connected to the form cylinder and includes a single wedge-shaped clamping element and a spring actuator disposed around the clamping device and extending in a radial direction of the form cylinder and acting on the wedge-shaped clamping element, wherein the clamping device is radially positioned in a clamping channel defined by the form cylinder which conforms to a first canted side of the wedge-shaped clamping element on a first side of the channel and a second radially-extending side of the wedge-shaped clamping element on a second side of the channel;

wherein a first end of a printing plate engages between the first canted side of the wedge-shaped clamping element and the form cylinder and wherein a second end of the printing plate engages between the second radially-extending side of the wedge-shaped clamping element and the form cylinder; and wherein, as seen in a circumferential direction, the clamping channel of the form cylinder has an effective clamping-channel width of at most 7 mm.

2. The apparatus according to claim 1, wherein the clamping channel of the form cylinder has an effective clamping-channel width of less than 7 mm.

3. The apparatus according to claim 1, wherein the clamping channel of the form cylinder has an effective clamping-channel width of between 3 mm to 7 mm.

4. The apparatus according to claim 3, wherein the clamping channel of the form cylinder has an effective clamping-channel width of between 3 mm to 6 mm, or of between 3 mm to 5 mm, or of between 3 mm to 4 mm.

5. The apparatus according to claim 3, wherein the clamping channel of the form cylinder has an effective clamping-channel width of between 4 mm to 7 mm, or of between 4 mm to 6 mm, or of between 4 mm to 5 mm.

6. The apparatus according to claim 3, wherein the clamping channel of the form cylinder has an effective clamping-channel width of between 5 mm to 7 mm or of between 5 mm to 6 mm.

7. The apparatus according to claim 3, wherein the clamping channel of the form cylinder has an effective clamping-channel width of between 6 mm to 7 mm.

8. The apparatus according to claim 1, wherein the form cylinder or the clamping channel has an axial length such that one printing plate can be positioned along the axial length of the form cylinder or of the clamping channel.

9. The apparatus according to claim 8, wherein the printing plate has at least one vertical printing page in the circumferential direction and/or an axial direction and/or at least one horizontal printing page in the circumferential direction and/or the axial direction.

10. The apparatus according to claim 1, wherein the form cylinder or the clamping channel has a circumferential extent such that one printing plate can be positioned on the form cylinder in the circumferential direction.

11. The apparatus according to claim 1, wherein the form cylinder defines only one clamping channel which extends over an entire axial length of the form cylinder such that one printing plate is able to be clamped on the form cylinder in the circumferential direction of the form cylinder.

12. A method for configuring a web-fed rotary press, comprising the steps of:

fastening a printing plate on a form cylinder;

wherein the printing plate is fastened in a clamping channel defined by the form cylinder by a clamping device that is threadedly connected to the form cylinder and includes a single wedge-shaped clamping element and a spring actuator disposed around the clamping device and extending in a radial direction of the form cylinder and acting on the wedge-shaped clamping element, wherein the clamping device is radially positioned in the clamping channel defined by the form cylinder which conforms to a first canted side of the wedge-shaped clamping element on a first side of the channel and a second radially-extending side of the wedge-shaped clamping element on a second side of the channel, and wherein a first end of the printing plate engages between the first canted side of the wedge-shaped clamping element and the form cylinder and wherein a second end of the printing plate engages between the second radially-extending side of the wedge-shaped clamping element and the form cylinder;

and wherein the clamping channel has an effective clamping-channel width of at most 7 mm.

13. The method according to claim 12 wherein the effective clamping-channel width is between 3 mm and 7 mm.

* * * * *